US010407833B2

(12) United States Patent
Seyrlehner

(10) Patent No.: US 10,407,833 B2
(45) Date of Patent: Sep. 10, 2019

(54) ATTACHMENT DEVICE FOR FIXING A TIE PLATE AND METHOD FOR PRODUCING A FIXING CLAMP

(71) Applicant: PLASSER & THEURER EXPORT VON BAHNBAUMASCHINEN GESELLSCHAFT M.B.H., Vienna (AT)

(72) Inventor: Georg Seyrlehner, Chesapeake, VA (US)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 245 days.

(21) Appl. No.: 15/375,808

(22) Filed: Dec. 12, 2016

(65) Prior Publication Data

US 2017/0191224 A1 Jul. 6, 2017

Related U.S. Application Data

(60) Provisional application No. 62/274,469, filed on Jan. 4, 2016.

(51) Int. Cl.
*E01B 9/02* (2006.01)
*E01B 9/38* (2006.01)

(52) U.S. Cl.
CPC . *E01B 9/02* (2013.01); *E01B 9/38* (2013.01)

(58) Field of Classification Search
CPC ..... E01B 3/16; E01B 3/28; E01B 3/32; E01B 9/02; E01B 9/40; E01B 9/44; E01B 13/02; E01B 15/00
See application file for complete search history.

(56) References Cited

U.S. PATENT DOCUMENTS 1,962,507 A * 6/1934 Hill ..... E01B 9/40 238/304
3,831,842 A * 8/1974 Tamura ..... E01B 3/40 238/282
5,617,795 A 4/1997 Glomski et al.
6,158,353 A 12/2000 Theurer
6,655,296 B2 12/2003 Theurer

* cited by examiner

*Primary Examiner* — Robert J McCarry, Jr.
(74) *Attorney, Agent, or Firm* — Laurence A. Greenberg; Werner H. Stemer; Ralph E. Locher

(57) ABSTRACT

An attachment device for provisionally or temporarily connecting a tie plate to a rail includes a U-shaped fixing clamp inserted slightly into a bore of the tie plate. A force-locking connection between the tie plate and the fixing clamp is established with the aid of a clamping bolt. A stop nose automatically also effects a connection between the tie plate and the rail. A simplified tie renewal can be performed as a result of the provisional or temporary connection. A method for producing an attachment device constructed as a fixing clamp is also provided.

16 Claims, 1 Drawing Sheet

ATTACHMENT DEVICE FOR FIXING A TIE PLATE AND METHOD FOR PRODUCING A FIXING CLAMP

CROSS-REFERENCE TO RELATED APPLICATION

This application claims the priority, under 35 U.S.C. § 119(e), of Provisional Application No. 62/274,469, filed Jan. 4, 2016; the prior application is herewith incorporated by reference in its entirety.

BACKGROUND OF THE INVENTION

Field of the Invention

The invention relates to an attachment device for fixing a tie plate which is positioned between a rail and a tie of a track and has bores for the passage of the attachment device. The invention also relates to a method for producing an attachment device constructed as a fixing clamp.

U.S. Pat. No. 5,617,795 discloses a tong-shaped device for gripping tie plates or base plates which are pressed against the rail base of a rail during the tie exchange.

According to U.S. Pat. No. 6,655,296, attachment devices are known for provisional or temporary connection of the tie plate to the rail in order to be able to perform an unobstructed tie exchange with reuse of the tie plate.

According to U.S. Pat. No. 6,158,353, it is further known to connect the tie plates to the rail base by provisionally or temporarily welding on rail spikes.

SUMMARY OF THE INVENTION

It is accordingly an object of the invention to provide an attachment device for fixing a tie plate and a method for producing a fixing clamp, which overcome the hereinaforementioned disadvantages of the heretofore-known devices and methods of this general type and with which a simplified provisional or temporarily connection between the tie plate and rail is possible.

With the foregoing and other objects in view there is provided, in accordance with the invention, an attachment device for temporarily fixing a tie plate having bores to a rail base of a rail, the attachment device comprising:

a) a U-shaped fixing clamp having first and second clamping legs to be partially inserted into the bore of the tie plate and having a clamp base interconnecting the clamping legs, the clamping legs having inner surfaces facing one another and outer surfaces facing away from one another;

b) a clamping bolt to be passed through a clamp bore formed in the clamp base; and c) a first stop nose attached to the outer surface of the first clamping leg for resting on the rail base.

With this kind of combination of features, a quick and satisfactory clamping effect of the fixing clamp in a bore of the tie plate can be achieved with minimal insertion of the clamping bolt, wherein a secure connection to the rail is automatically ensured by using the stop nose.

With the objects of the invention in view, there is concomitantly provided a method for producing a fixing clamp of an attachment device for temporarily fixing a tie plate having bores to a rail base of a rail, which comprises cutting the clamping legs together with the clamp base and the stop nose or stop noses in one piece from a sheet metal plate.

According to the steps of the method, the fixing clamp can be fashioned very easily in an advantageous manner by cutting it out from a sheet metal plate. This advantage can be maintained unimpaired even with the use of additional advantageous stop noses.

Other features which are considered as characteristic for the invention are set forth in the appended claims.

Although the invention is illustrated and described herein as embodied in an attachment device for fixing a tie plate and a method for producing a fixing clamp, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 3:
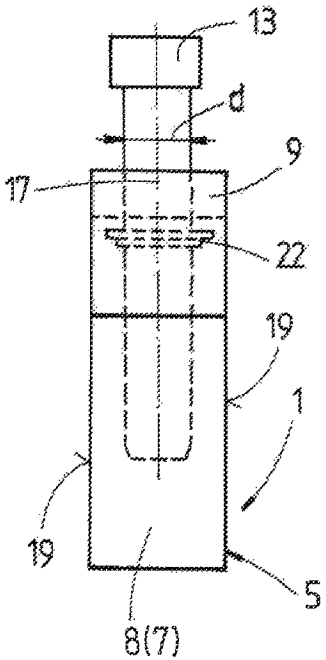
FIG. 3 is a front-elevational view of the fixing clamp.
Figure 2:
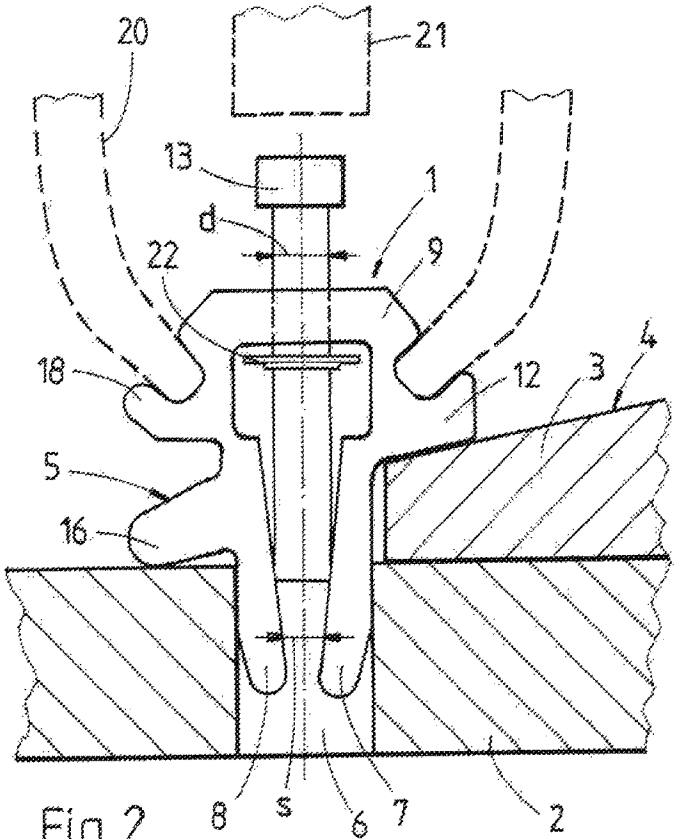
FIG. 2 is a partly sectional view of the fixing clamp fixing a rail to a tie plate.
Figure 1:
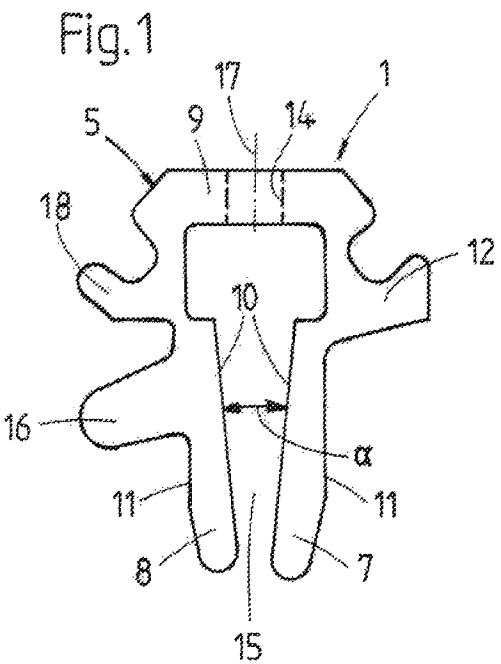
FIG. 1 is a diagrammatic, side-elevational view of a fixing clamp including a plurality of stop noses.

Referring now in detail to FIGS. 1 to 3 of the drawings as a whole, there is seen an attachment device 1 which is provided for a provisional connection of a partially-illustrated tie plate 2 (see also U.S. Pat. No. 6,655,296 in this context) to a rail base 3 of a rail 4 of a track which is not shown in further detail. Through the use of this attachment device 1, an unhindered renewal of a tie located underneath the tie plate 2 is possible.

The attachment device 1 is constructed as a substantially U-shaped fixing clamp 5 having first and second clamping legs 7, 8 intended for partial insertion into a bore 6 of the tie plate 2. These clamping legs are connected to one another by a clamp base 9 and have inner surfaces 10 facing one another as well as outer surfaces 11 facing away from one another. Attached to the outer surface 11 of the first clamping leg 7 is a first stop nose 12 intended for resting on the rail base 3. The clamp base 9 has a clamp bore 14 provided for passage of a clamping bolt 13 (see FIG. 2).

The two inner surfaces 10 of the clamping legs 7, 8 form a receiving channel 15 for the clamping bolt 13 and enclose an angle $\alpha$ of approximately 10° to approximately 20° with one another. As a result, the two inner surfaces 10 approach one another with increasing distance from the clamp base 9. A diameter d of the clamping bolt 13 is greater than a distance s between the two inner surfaces 10, in which the distance s is situated in an end region of the two clamping legs 7, 8 spaced from the clamp base 9.

The second clamping leg 8 has a second stop nose 16 disposed at the outer surface 11 thereof and provided for being applied to the tie plate 2. The second stop nose 16 is spaced farther from the clamp base 9 than the first stop nose 12. A third stop nose 18, which is additionally disposed at the outer surface 11 of the second clamping leg 8, lies opposite the first stop nose 12 relative to a bore axis 17 of the clamp bore 14.

As can be seen particularly in FIG. 3, the two clamping legs 7, 8 together with the clamp base 9 and the stop nose(s) 12, 16, 18 form two clamp side surfaces 19 extending parallel to one another.

The two clamping legs 7, 8 together with the clamp base 9 and the stop noses 12, 16, 18 are cut in one piece from a sheet metal plate for a particularly simple fabrication of the fixing clamp 5. This automatically results in the outlines or outer surfaces seen in FIGS. 1 and 2. Subsequently it is merely necessary to produce the clamp bore 14 and to insert the clamping bolt 13 through the clamp bore 14 and through a washer 22. The latter prevents the clamping bolt 13 from falling out of the receiving channel 15.

In order to install the fixing clamp 5, the fixing clamp 5, together with the clamping bolt 13 inserted through the clamp bore 14, is gripped with the aid of pliers 20, shown in dashed lines, and inserted into the bore 6 of the tie plate 2 until, on one hand, the first stop nose 12 rests against the rail base 3 and, on the other hand, the second stop nose 16 rests on the tie plate 2. Thereafter, the clamping bolt 13 is pressed slightly in the direction of the tie plate 2 with the aid of a punch 21, so that the lower ends of the clamping legs 7, 8 are pressed toward the tie plate 2 inside the bore 6. Thus, a temporary connection between the rail 4 and the tie plate 2 is established. This connection can be undone again quite simply with reversal of the above-described steps as soon as the tie underneath the tie plate 2 has been renewed.

The invention claimed is:

1. An attachment device for temporarily fixing a tie plate having bores to a rail base of a rail, the attachment device comprising:

a) a U-shaped fixing clamp having first and second clamping legs to be partially inserted into the bore of the tie plate and having a clamp base interconnecting said clamping legs, said clamping legs approaching one another with increasing distance from said clamp base, said clamping legs having inner surfaces facing one another and outer surfaces facing away from one another, said inner surfaces forming a receiving channel;

b) a clamping bolt to be passed through a clamp bore formed in said clamp base and to be inserted into said receiving channel; and c) a first stop nose attached to said outer surface of said first clamping leg for resting on the rail base.

2. The attachment device according to claim 1, wherein said inner surfaces of said clamping legs enclose an angle of approximately 10° to approximately 20° with one another.

3. The attachment device according to claim 2, wherein said clamping legs have an end region remote from said clamp base, said inner surfaces of said clamping legs are spaced apart by a distance in said end region, and said clamping bolt has a diameter greater than said distance.

4. The attachment device according to claim 1, which further comprises a second stop nose disposed at said outer surface of said second clamping leg for application to a tie plate.

5. The attachment device according to claim 4, wherein said second stop nose is disposed farther from said clamp base than said first stop nose.

6. The attachment device according to claim 5, which further comprises a third stop nose disposed at said outer surface of said second clamping leg, said third stop nose being disposed opposite said first stop nose relative to a bore axis of said clamp bore.

7. The attachment device according to claim 1, wherein said clamping legs together with said clamp base and said first stop nose form two clamp side surfaces extending parallel to one another.

8. The attachment device according to claim 4, wherein said clamping legs together with said clamp base and said first and second stop noses form two clamp side surfaces extending parallel to one another.

9. The attachment device according to claim 6, wherein said clamping legs together with said clamp base and said first, second and third stop noses form two clamp side surfaces extending parallel to one another.

10. The attachment device according to claim 6, wherein said clamping legs together with said clamp base and said first, second and third stop noses are formed in one piece from a sheet metal plate.

11. The attachment device according to claim 1, wherein said U-shaped fixing clamp directly attaches the tie plate to the rail base.

12. A method for producing a fixing clamp of an attachment device for temporarily fixing a tie plate having bores to a rail base of a rail, the method comprising the following steps:

providing a U-shaped fixing clamp having first and second clamping legs to be partially inserted into the bore of the tie plate and a clamp base interconnecting the clamping legs, the clamping legs having inner surfaces facing one another and forming a receiving channel and outer surfaces facing away from one another, the clamping legs approaching one another with increasing distance from the clamp base;

providing a clamping bolt to be passed through a clamp bore formed in the clamp base and inserted into the receiving channel;

providing a first stop nose at the outer surface of the first clamping leg for resting on the rail base; and cutting the clamping legs together with the clamp base and the first stop nose in one piece from a sheet metal plate.

13. The method according to claim 12, which further comprises:

providing a second stop nose at the outer surface of the second clamping leg for application to a tie plate;

providing a third stop nose at the outer surface of the second clamping leg at a location opposite the first stop nose relative to a bore axis of the clamp bore; and cutting the second and third stop noses from the sheet metal plate in one-piece with the clamping legs, the clamp base and the first stop nose.

14. The method according to claim 12, which further comprises using the U-shaped fixing clamp to directly attach the tie plate to the rail base.

15. An attachment device for temporarily fixing a tie plate having bores to a rail base of a rail, the attachment device comprising:

a) a U-shaped fixing clamp having first and second clamping legs with free ends to be partially inserted downwardly into the bore of the tie plate, said clamping legs having a clamp base interconnecting said clamping legs, and said clamping legs having inner surfaces facing one another and outer surfaces facing away from one another;

b) a clamping bolt to be passed through a clamp bore formed in said clamp base; and c) a first stop nose attached to said outer surface of said first clamping leg for resting on the rail base.

16. A method for producing a fixing clamp of an attachment device for temporarily fixing a tie plate having bores to a rail base of a rail, the method comprising the following steps:

providing a U-shaped fixing clamp having first and second clamping legs with free ends to be partially inserted downwardly into the bore of the tie plate, the clamping legs having a clamp base interconnecting the clamping legs, and the clamping legs having inner surfaces facing one another and outer surfaces facing away from one another;

providing a clamping bolt to be passed through a clamp bore formed in the clamp base;

providing a first stop nose at the outer surface of the first clamping leg for resting on the rail base; and cutting the clamping legs together with the clamp base and the first stop nose in one piece from a sheet metal plate.

* * * * *